United States Patent [19]

Wilson et al.

[11] 3,953,246

[45] Apr. 27, 1976

[54] GOLD DIFFUSION PROCESS AND SHAPED METAL ARTICLES THEREBY

[75] Inventors: Robert Wilson, Dundee; James Ramsay, Carnoustie, both of Scotland

[73] Assignee: Timex Corporation, Waterbury, Conn.

[22] Filed: Nov. 14, 1974

[21] Appl. No.: 521,610

[52] U.S. Cl. ..... 148/11.5 R; 148/31.5; 204/37 R; 204/37 T

[51] Int. Cl.[2] ..... C22F 1/08

[58] Field of Search ..... 148/11.5 R, 31.5, 2, 148/11.5 Q, 11.5 C; 204/37 R, 37 T

[56] References Cited

UNITED STATES PATENTS 3,157,539 11/1964 Dreher ..... 148/31.5

*Primary Examiner*—R. Dean

[57] ABSTRACT

An improved gold diffusion coated shaped copper alloy article is provided by forming a copper alloy with chemical composition in the range 1 to 10% of aluminum and/or 0 to 10% of tin and optionally from 0 to 5% of free machining additives such as lead, selenium, tellurium, silicon, or others, remainder copper, into a desired shape and heating the shaped article to a temperature of from 700°C to 900°C and thereafter quenching the article at a controlled rate either in a gas or liquid quenchant. The shaped and hardened article is then galvanically coated with a layer of gold or gold alloy from 1 to 5 microns thick, and the gold coating diffused into the hardened copper alloy body by heating at a temperature from 400°C to 900°C for from less than one minute to 30 minutes, thereby diffusing the gold into the hardened base copper alloy. The process is particularly useful in forming watch bezels.

The heating and quenching of the shaped copper alloy article forms a fine-grained eutectoid duplex two phase structure which is believed to enhance the rate and depth of diffusion and evenness of penetration of the gold layer. Gold coated hardened copper alloy articles of enhanced durability, resistant to corrosion, and having an aesthetically pleasing finish are obtained.

In a preferred embodiment, a watch bezel is shaped from copper alloy with chemical composition of 7% aluminum, 7% tin and optionally up to 5% free machining additive such as lead, selenium, tellurium or others, remainder copper which is shaped and machined to the configuration of the watch bezel, heated to 900°C and quenched at a desired cooling rate by means of gas or liquid quench. The shaped article is then galvanically plated with a 5 micron layer of 24 karat gold and the plated article heated at 600°C for 15 minutes.

17 Claims, No Drawings

GOLD DIFFUSION PROCESS AND SHAPED METAL ARTICLES THEREBY

BACKGROUND OF THE INVENTION

1. Field of the Invention

The present invention relates to shaped heat hardened base metal alloy articles which are initially coated with a layer of noble metal especially gold which is, in turn, diffused into the body of the base metal alloy. The invention is particularly concerned with producing shaped metal articles comprised of a base metal of copper alloy over which lies a covering of gold or gold alloy. Shaped metal articles according to the present invention are utilized where the ultimate article being manufactured is one which requires good machineability properties, strength, durability and resistance to corrosion and discoloring. This invention is particularly concerned with the formation of shaped metal articles of the type described which serve a decorative function and which can be polished to a high degree of sheen such as watch bezels.

It is important that the article manufactured be relatively hard, resistant to dents, scratches and the like and have a durable and attractive coating of a noble metal which can be polished to a high sheen and is resistant to pits, scratches, discoloring and corrosion.

2. Prior Art

Various techniques have been employed in the past in the manufacture of articles from heat hardenable copper alloys which are diffusion coated with a noble metal. It has generally been found that it is unsuitable to coat the copper alloy prior to the shaping and finishing operation because of the physical changes which occur in the properties of the underlying body and the coating during the shaping and finishing operation. The thickness of the plated layer was often changed in forming steps after coating so that it varied in an irregular manner as well as disturbed the smooth finish of the coating metal producing a rough, uneven surface which was difficult to finish to an aesthetically acceptable degree. Excessive polishing and the like also diminished the thickness of the finished layer to an unacceptable degree.

In instances where the article had been plated before shaping and other fabrication steps, any cutting and the like would expose unplated portions to corrosion as well as ruining the aesthetic appearance of the article.

Various alternative approaches have been attempted to overcome these problems. One obvious approach is to form the shaped body of the base metal or alloy and apply the noble metal coating only after the shaping of the article has been completed. The adherence of the noble metal coating to the shaped body is then assured by diffusion heating which at first was carried out for short periods of time at relatively high temperatures often within the softening range of the base metal or base metal alloy. In order to prevent the deformation of the article during high temperature diffusion heating, the treatment was carried out in a hot salt melt which unfortunately, however, often adversely effected the mechanical properties of the product. In cases where the noble metal was merely plated on to the underlying shaped base metal article and not diffused into the shaped base metal article by subsequent diffusion heat treatment, the coating lacked sufficient adherence to provide the desired durability and corrosion resistance.

In U.S. Pat. No. 3,157,539 Dreher, a process is disclosed for making shaped metallic bodies having a noble metal coating wherein the underlying metal or alloy is one which is heat hardenable by shaping the object from heat hardenable copper alloy in its unhardened condition, applying a coating of noble metal to the shaped body of the base metal which noble metal is adapted to be firmly joined to the shaped body of the copper alloy by diffusion heat treatment. The patentee indicates that the underlying base metal is hardenable within a first temperature range, that the heat diffusion process takes place within a higher second temperature range. The first and second temperature ranges partially overlap each other to define a third temperature range in which the formed and coated metal body is finally heated to simultaneously harden the underlying base copper alloy and diffuse the noble metal coating into the formed base metal. The process disclosed by the patentee comprises in effect a compromise between hardening the underlying metal at the preferred temperature range and simply adopting a single temperature range to simultaneously carry out both processes at the supposed third temperature range which is ideal neither for hardening nor diffusing. Thus, the final shaped and coated metal body has neither the best mechanical properties nor is the diffused coating as firmly adhered and uniformly diffused as desired. As indicated in the patent, the temperature range at which the hardening and diffusing is simultaneously carried out ranges from 350°C to 600°C with a temperature of apparently 500°C being preferred. The base metal utilized in this patent is a copper or copper alloyed with beryllium or with silicon and manganese, or with silicon and nickel. The plating metal is gold or a gold alloy.

An additional difficulty which is encountered using some of the alloys previously employed in forming shaped metal articles mentioned is the difficulty in machining and shaping the article. This is believed due to the fact that most of the previous alloys employed in this type of manufacturing process have excluded free machining additives such as lead, selenium, tellurium or others.

A recent approach in this area to provide a shaped metal article of increased hardness and corrosion resistance has employed as the underlying metal a copper alloy which is a bronze comprised of copper, aluminum and nickel from which tin, zinc and lead have been excluded.

In one recent development, a bronze alloy of aluminum, nickel and copper has been electrically plated with about 4 microns of gold following machining. The machined workpiece was a watch bezel. After plating, the plated piece was simultaneously hardened and the gold layer diffused in a heat treatment.

It was thought necessary in this process to coat the gold diffused coating with a final coating of a hard metal selected from chromium, rhodium, ruthenium and the like to a thickness of approximately 20 microns because the diffused gold layer was not durable enough.

SUMMARY OF THE INVENTION

We have found that shaped metal articles of improved hardness, durability, corrosion resistance, and possessing improved finished appearance can be readily manufactured according to the process which we have discovered. A heat hardenable copper alloy is shaped and formed prior to any heat treatment or plating operation. Following the formation or shaping of the article from the specific heat hardenable copper alloy, the shaped article is heated and quenched from the temperature to which it is heated in order to form a structure comprised of a fine grain eutectoid and alpha-crystal phase duplex structure.

The shaped article which has been heat treated and hardened is then galvanically plated with a layer of fine gold or gold alloy usually to a thickness of from 1 to 5 microns although greater thicknesses may be employed if desired. The plated article is then heat treated at a temperature of from about 400°C to about 900°C for from less than one minute to about 30 minutes, thereby diffusing the gold plated layer into the hardened base copper alloy and producing a hardened, corrosion resistant, and durable shaped metal article which can in turn be highly polished for aesthetic purposes. We have found that the preferred base copper alloy to employ is one which is comprised of aluminum, tin with the balance copper. In order to enhance the machineability, another preferred alloy is one which comprises aluminum, tin and copper, plus from 0.1 to 5 free machining additives such as lead, selenium or tellurium, silicon, or others. A preferred range of free machining additives is 0.1 to 3% with 2 to 3% by weight most preferred. The alloying metals may range in amounts from approximately 1 to 10% for aluminum and 0 to 10% for tin. The preferred ranges are from 5 to 7% for both aluminum and tin, and from 0 to 3% free machining additives, with the balance copper. The most preferred composition of the alloy is one which is 7% aluminum, 7% tin plus approximately 3% of free machining additives, and the balance copper. Any appreciable amounts of nickel are excluded from the alloys employed according to the present invention.

Utilizing the copper alloys mentioned, we have found that the heating of the hardenable alloy prior to the coating step has been most effective when the shaped alloy and the machined alloy body has been heated to approximately from 700° to 900°C, preferably about 900°C, for 2 to 30 minutes, and thereafter quenched at a controlled rate. The important point, however, depending upon the particular composition of the alloy utilized, is to quench from a temperature which will produce a fine-grained eutectoid duplex structure, since it is believed that it is the duplex structure of the alpha-crystalline phase and fine-grained eutectoid which enhances the depth and effectiveness of the subsequent diffusion of the coated gold into the shaped structure.

We have found that the preferred temperature range for the diffusion step is approximately 400° to 700°C, preferably 600°C, for from less than 1 minute to 15 minutes, and most preferred at temperatures of approximately 600°C for about 15 minutes. As indicated, the layer of gold applied can range from approximately 2 microns to 5 microns with about 4 microns being preferred. Tests following the diffusion step have indicated that the gold has diffused into the shaped structure to depths on the order of 50 microns although it is preferred to adjust the process to concentrate a relatively high percentage of gold on the outer 5 to 10 microns from the surface, thus giving the optimum corrosion resistance.

As indicated above, while it does not appear to be necessary in order to obtain a hard, durable structure that is corrosion resistant, it is preferable to include up to about 3% by weight free machining additive in the heat hardenable copper alloy in order to enhance its machineability.

It is believed that the combination of the particular copper alloy utilized together with the heat treatment prior to any coating with the noble metal produces a fine-grained eutectoid or transformed eutectoid structure free of large areas of alpha-phase crystals which leads to a controlled diffusion and increases the concentration across the diffused layer. Also the diffusion is very rapid.

DESCRIPTION OF PREFERRED EMBODIMENTS

Four samples of the alloy comprising 7% tin, 7% aluminum and the balance copper which had been shaped, machined into watch bezels, and heat treated by heating to 900°C and quenching as previously indicated were galvanically plated with 24 karat gold using conventional plating techniques. The samples were plated with approximately 2 microns of the gold. Thereafter the samples were heat treated as follows to diffuse the gold into the base metal structure:

| Sample | Temperature | Time |
|---|---|---|
| 1 | 600°C | 0 min. (less than 1 min.) |
| 2 | 600°C | 5 min. |
| 3 | 600°C | 15 min. |
| 4 | 750°C | 0 min. (less than 1 min.) |

Each sample produced a corrosion resistant hardened gold plated structure with gold diffused to the depth of at least 20 microns into the copper alloy base metal.

The foregoing procedures are repeated using base alloys having the following composition:

A. 5% aluminum, 5% tin, balance copper
B. 7% aluminum, 5% tin, balance copper
C. 5% aluminum, 7% tin, balance copper In each case, the alloy employed is free of the presence of any nickel. Equally good results are obtained.

The procedures above are repeated using alloys of varying composition within the scope of the invention for differing times and temperatures within the ranges disclosed.

The combination of the particular alloys and the initial heat treatment to form a eutectoid phase in the copper alloy enhances the hardening before application of the gold and greatly enhances the diffusion of the gold into the base alloy in terms of depth, evenness and time required.

While the invention has been explained by a detailed description of certain specific embodiments, it is understood that various modifications and substitutions can be made in any of them within the scope of the appended claims which are intended also to include equivalents of such embodiments.

What is claimed is:

1. A shaped metallic body comprised of a copper alloy base metal and a noble metal diffusion layer over said base metal, the shaped base metal being heat hardened and comprising a fine-grained eutectoid or duplex phase and an alpha-crystalline phase, the shaped base metal body having been hardened prior to coating with said noble metal and said diffusion coating penetrating said base metal to a depth at least 20 microns and adjusting conditions in the diffusion treatment to give maximum gold concentration over the first 5 to 10 microns from the surface.

2. An article as claimed in claim 1 wherein said copper alloy comprises from about 1% to about 10% by weight of aluminum, from 0 to 10% by weight of tin, the balance being copper.

3. An article as claimed in claim 1 wherein said base metal copper alloy is nickel free.

4. An article as claimed in claim 2 wherein said base metal copper alloy is nickel free.

5. An article as claimed in claim 4 wherein said aluminum and tin comprise from 5 to 7% by weight, the balance being copper.

6. An article as claimed in claim 5 wherein the alloy is comprised of 7% aluminum, 7% tin, 3% lead or other free machining additive, and the balance copper.

7. An article as claimed in claim 6 wherein said base copper alloy body has been hardened by heating it before coating to a temperature of from 700°C to 900°C, followed by quenching in gas or liquid.

8. An article as claimed in claim 7 wherein said article following galvanic coating with a noble metal has been heated to from 400°C to 700°C for approximately from less than one minute to 30 minutes.

9. An article as claimed in claim 8 wherein the first heating step is carried out at approximately 900°C and the second heating is carried out at approximately 600°C for from less than one minute to 15 minutes.

10. A process of producing a shaped copper alloy body which comprises the step of shaping a heated hardenable copper alloy in the unhardened condition to the desired configuration, heating said heat hardenable copper alloy to a temperature of from about 700°C to 900°C for about 2 to about 30 minutes and thereafter quenching said shaped metallic body thereby hardening said body and forming a fine-grained eutecoid or duplex phase and an alpha-crystalline phase structure, then coating at least a portion of the thus formed hardened shaped body with a metal selected from the group consisting of gold and gold alloys and being capable of forming a heat diffusion coating on said shaped metallic copper alloy body when subjected to diffusion causing heat treatment, thereafter heating said coated body to a temperature of from 400°C to about 900°C for a period of from less than one minute to 30 minutes thereby diffusing said gold coating into said shaped copper alloy body.

11. A process as claimed in claim 10 wherein said copper alloy is nickel free and comprises from 1 to 10% of aluminum and 0 to 10% by weight tin, the balance being copper.

12. A process as claimed in claim 11 wherein said copper alloy further comprises 0.1 to 3% by weight of lead, selenium, tellurium, silicon, or other free machining additive.

13. A process as claimed in claim 12 wherein said copper alloy comprises from 5 to 7% by weight each of aluminum and tin and from 0.1 to 3% by weight of lead, selenium, tellurium, silicon, or other free machining additive.

14. A process as claimed in claim 13 wherein said copper alloy comprises approximately 7% tin, 7% aluminum, 0.1 to 3% lead, selenium, tellurium, silicon or other free machining additive and the balance copper.

15. A process as claimed in claim 10 wherein said shaped copper alloy body is galvanically coated with from 1 to 5 microns of gold.

16. A process as claimed in claim 11 wherein said heat diffusion step is carried out at temperatures of from 400° to 700°C.

17. A process as claimed in claim 16 wherein said process is carried out at a temperature of about 600°C for from less than one minute to 15 minutes.

* * * * *